US008037839B2

(12) United States Patent
Thistle

(10) Patent No.: US 8,037,839 B2
(45) Date of Patent: Oct. 18, 2011

(54) DEVICE FOR HANDLING A LOAD HOISTED BETWEEN TWO LOCATIONS OFFSET BOTH VERTICALLY AND HORIZONTALLY

(76) Inventor: Owen James Thistle, Calgary (CA)

( * ) Notice: Subject to any disclaimer, the term of this patent is extended or adjusted under 35 U.S.C. 154(b) by 215 days.

(21) Appl. No.: 11/946,649

(22) Filed: Nov. 28, 2007

(65) Prior Publication Data

US 2008/0128375 A1 Jun. 5, 2008

Related U.S. Application Data

(60) Provisional application No. 60/861,305, filed on Nov. 29, 2006.

(51) Int. Cl.
*B63B 23/00* (2006.01)
*B63B 23/04* (2006.01)

(52) U.S. Cl. ..... 114/373; 294/157; 114/268; 114/343; 312/311; 414/137.9

(58) Field of Classification Search ..... 114/268, 114/343, 364, 373, 9; 150/157; 212/180, 212/273, 294, 307, 311; 29/157, 165, 67.33; 414/137.5

See application file for complete search history.

(56) References Cited

U.S. PATENT DOCUMENTS

| | | | | | |
|---|---|---|---|---|---|
| 252,480 | A * | 1/1882 | Laurence | 114/373 |
| 514,661 | A * | 2/1894 | Paul | 114/373 |
| 1,083,065 | A * | 12/1913 | Doxford | 114/373 |
| 1,090,588 | A * | 3/1914 | Wylie | 114/373 |
| 1,192,158 | A * | 7/1916 | Binks | 114/373 |
| 1,344,754 | A * | 6/1920 | Clark | 114/373 |
| 1,398,702 | A * | 11/1921 | Desiderio | 114/373 |
| 2,045,533 | A * | 6/1936 | Smaltz | 254/266 |
| 2,187,439 | A * | 1/1940 | Woodeson et al. | 212/308 |
| 2,997,188 | A * | 8/1961 | Hauser | 414/137.7 |
| 3,341,035 | A * | 9/1967 | Black | 414/142.8 |
| 3,664,224 | A * | 5/1972 | Campagna, Jr. | 84/327 |
| 5,018,473 | A * | 5/1991 | Foster | 114/249 |
| 5,590,618 | A * | 1/1997 | Marshall | 114/343 |
| 5,706,755 | A * | 1/1998 | O'Brien | 114/365 |
| 6,357,380 | B2 * | 3/2002 | Holcomb et al. | 114/373 |
| 7,070,059 | B1 * | 7/2006 | Flowers et al. | 212/180 |
| 2004/0031096 | A1 * | 2/2004 | Liljedahl | 5/89.1 |

* cited by examiner

*Primary Examiner* — Gregory Adams
(74) *Attorney, Agent, or Firm* — St. Onge Steward Johnston & Reens LLC

(57) ABSTRACT

A device for handling a load hoisted between two locations offset both vertically and horizontally is described. In particular the device is useful for transferring an outboard motor between an operating location on a dinghy and a storage location on a larger boat. The device makes use of existing lifting devices such as sail halyards and winches and provides both guidance and stabilization of the motor during the transfer.

12 Claims, 16 Drawing Sheets

DEVICE FOR HANDLING A LOAD HOISTED BETWEEN TWO LOCATIONS OFFSET BOTH VERTICALLY AND HORIZONTALLY

CROSS-REFERENCE TO RELATED APPLICATIONS

This application claims the benefit of priority from U.S. provisional application 60/861,305 filed Nov. 29, 2006.

FIELD OF THE INVENTION

A device for handling a load hoisted between two locations offset both vertically and horizontally is described. In particular the device is useful for transferring an outboard motor between an operating location on a dinghy and a storage location on a larger boat. The device makes use of existing lifting devices such as sail halyards and winches and provides both guidance and stabilization to the motor during transfer.

BACKGROUND OF THE INVENTION

Large boats commonly tow or carry a smaller boat or dinghy for use as a tender to the larger boat and an outboard motor is commonly used as a means of propulsion for the dinghy. Usually when the larger boat is under way or the dinghy is otherwise not being utilized, most operators prefer that the outboard motor is removed from the tender and stored on the boat to minimize the risk of losing or damaging the outboard motor. Unfortunately, for many boaters and boats, various combinations of the weight of the outboard motor, obstacles such as rigging and railings, wave-induced motion of both vessels and/or the physical capabilities of the boaters can make any lifting of the outboard motor from the dinghy and the subsequent return of the outboard motor to the dinghy difficult.

One solution to this problem is the use of a lifting device such as a crane or davit installed on the boat to provide the power or mechanical advantage for lifting or lowering the weight of the outboard motor. Such devices occupy space on the deck, railing or transom of the boat, and may impede the use of particular locations of the boat or simply detract from the aesthetic appearance of the boat. Moreover such systems may not be accommodated on some boats where the required deck or railing space is not available. Still further, such existing lifting devices often do not provide good stabilization of the outboard motor movement relative to the boat due to various factors including wave-induced motion of the boat. In this case, collision between the outboard motor and the main boat can result, causing damage to either or both. Further still, the costs of purchase and installation of such devices is elevated due to the mechanisms required and mechanical forces involved.

There is also a significant concern for many boaters, particularly older and physically less-capable boaters, of recovering a person who may have fallen overboard at sea. For many man-overboard victims, either as a result of the time spent in the water and/or their physical limitations, they are incapable of assisting themselves when a recovery vessel has come alongside to retrieve them from the water. In these situations, the people on the recovery vessel must be able to lift a potentially incapacitated and very heavy person on board. Still further, particularly in rough seas, there is a significant risk of injuring the victim against the sides of the vessel.

While many boats have existing hoisting mechanisms such as sail halyards and winches which can be used as a means for lifting or lowering a heavy load such an outboard motor or a person, the use of such systems on their own do not provide a means for controlling both the lateral and vertical movement of the load which will often result in an unsafe handling of the load.

As a result, there has been a need for an improved system for lifting and controlling heavy loads onto boats and particularly, for ease of handling of outboard motors and other loads such a person who has fallen overboard.

A review of the prior art reveals that various lifting systems have been designed and utilized in the past for boats for lifting and handling cargoes such as outboard motors as well as man-overboard recovery systems. For example, Forespar Products (Rancho Santa Margarita, Calif.) market various davit lifting systems for outboard motors such as the Motor Mate™ system. As well, there are numerous man-overboard products on the market that aid in the recovery of a man-overboard victim.

A review of the patent literature reveals U.S. Pat. No. 4,705,179, U.S. Pat. No. 5,020,708, U.S. Pat. No. 4,545,770, U.S. Pat. No. 4,545,559, U.S. Pat. No. 4,465,423, U.S. Pat. No. 4,232,627, U.S. Pat. No. 4,880,345, U.S. Pat. No. 5,590,618, U.S. Pat. No. 5,137,481, U.S. Pat. No. 5,297,835, U.S. Pat. No. 5,558,382 and U.S. Pat. No. 5,645,307 which relate to various outboard motor handling equipment.

However, these systems do not provide simple but effective systems for controlling both the vertical and lateral movement of the load towards and onto the vessel.

SUMMARY OF THE INVENTION

In accordance with the invention, there is provided a lightweight, inexpensive and compact lifting system that may be used in conjunction with existing lifting mechanisms to safely transfer both vertically and laterally a load onto and off a boat.

In a first embodiment, the invention provides a lifting system for use with a boat for vertically and horizontally moving a load to and from a boat, comprising: a pivot arm having a cross member defining a free end and two legs for pivotable connection to a boat, the pivot arm operable between a lower position and an upper position; and, a load supporting system operatively connected to the free end of the pivot arm and for operative connection to a lifting line on the boat, the load supporting system operatively retaining a lifting hook for connection to a load, the load supporting system including a securing system for securing the lifting hook in close proximity to the pivot arm.

In one embodiment, the lifting system includes at least one supporting line operatively connected to the pivot arm and the boat for supporting the pivot arm in the lower position.

In a further embodiment, the securing system includes a catching hook operatively connected to the free end for supporting the lifting hook and load when the pivot arm is in a pre-determined position between the lower position and upper position. In another embodiment, the load supporting system is a strap having a one-way and releasable latch.

In one embodiment, the system includes a pivot arm catch attached to the boat for releasably securing the pivot arms in the upper position.

In yet another embodiment, the load supporting system is a strap and the load is an outboard motor, the lifting system further comprising a harness for supporting the outboard motor and wherein the harness, strap and lifting hook are arranged in order to allow rotation of the outboard motor to fit between the pivot arm legs in the upper position from induced torsional tension within the strap.

The system may also include at least one elastic line operatively connected to the at least one supporting line for maintaining tension in the supporting lines when the pivot arm is in the upper position.

In another embodiment, the system may be used as a man-overboard recovery system and include a harness or seat adapted for lifting a person from the water.

In a more specific embodiment, the invention provides a lifting system for use with a boat for vertically and horizontally moving an outboard motor to and from a boat, comprising: a pivot arm having a cross member defining a free end and two legs for pivotable connection to a boat, the pivot arm operable between a lower position and an upper position; at least one supporting line operatively connected to the pivot arm and the boat for supporting the pivot arm in the lower position; a load supporting system comprising a strap operatively connected to the free end of the pivot arm and for operative connection to a lifting line on the boat, the strap operatively retaining a lifting hook for connection to an outboard motor harness having a handle, the load supporting system including a securing system for securing the lifting hook in close proximity to the pivot arm and wherein the securing system includes a catching hook operatively connected to the free end for supporting the lifting hook and load when the pivot arm is in a pre-determined position between the lower position and upper position and wherein the harness, strap and lifting hook are arranged in order to allow rotation of the outboard motor to fit between the pivot arm legs in the upper position from induced torsional tension within the strap; and, at least one elastic line operatively connected to the at least one supporting line for maintaining tension in the supporting lines when the pivot arm is in the upper position.

BRIEF DESCRIPTION OF THE DRAWINGS

The invention is described with reference to the figures wherein.

DETAILED DESCRIPTION OF THE INVENTION

Figure 1:
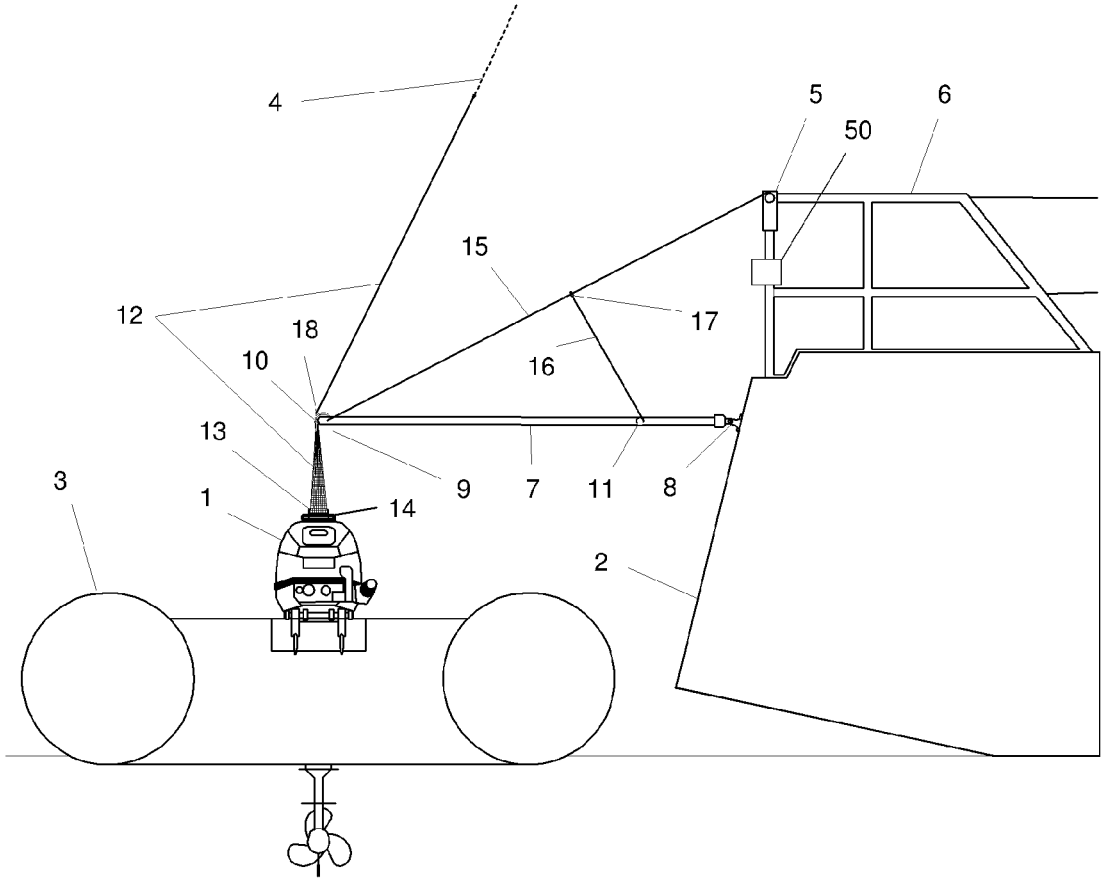
FIG. 1 is a diagram showing a side view of one embodiment of the invention installed on a boat and connected to an outboard motor on a dinghy.

With references to the Figures, a system for easily and safely transferring a heavy load between two locations vertically and horizontally displaced from one another is described. More specifically, a system for effectively lifting a heavy load such as an outboard motor or a person to and from a boat is described.

The following description is written in the context of a system for lifting an outboard motor between a storage location on a boat and an operating location on a dinghy. It is understood that the system may be applied to other objects as will be discussed below.

System Overview

As shown in the Figures, the system is used for transferring an outboard motor 1 between a storage location, typically an outboard motor bracket 5, on a boat 2 and a dinghy 3. The system makes use of an existing halyard or other lifting line 4 as well as an existing railing 6, outboard motor bracket 5, and outboard motor lifting harness 19 with handle 14.

Figure 2:
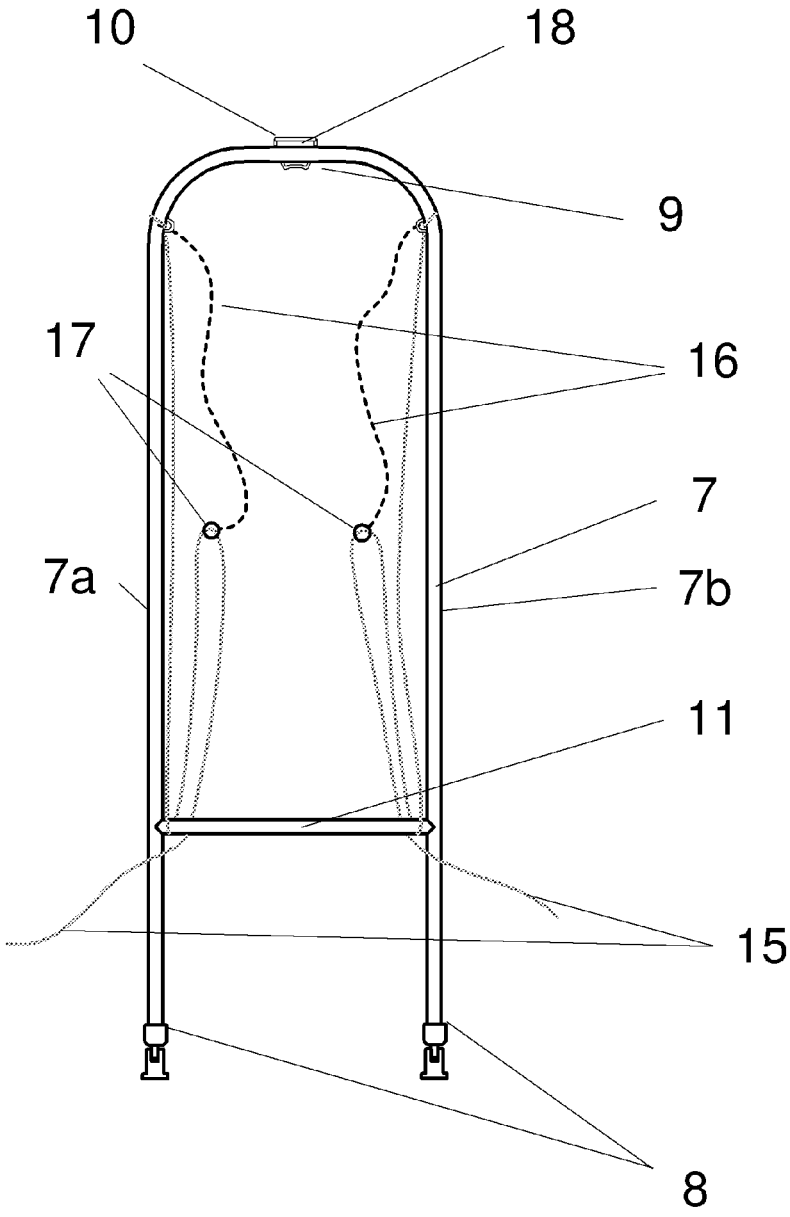
FIG. 2 is a diagram showing one embodiment of a pivot arm with associated parts.

As shown in FIGS. 1 and 2, the system includes a U-shaped pivot arm 7 having legs 7*a* and 7*b*. Legs 7*a*, 7*b* are mounted to a boat 2 with hinges 8 such that the axes of the hinges lie on a horizontal line. The U-shaped arm is wide enough for an outboard motor 1 to pass between the legs. The legs are connected to the boat by hinges at the lower end of the legs of the pivot arm such that the pivot arm is able to rotate about a horizontal hinge axis near the mounting point. One or more restraining lines (or hinged rigid members, not shown) 15 are connected to the boat railing 6 or other structural member of the boat and to the upper end (or free end) of the pivot arm 7 to prevent the pivot arm from rotating below a lower limit determined by the length of the restraining lines 15.

Figure 3:
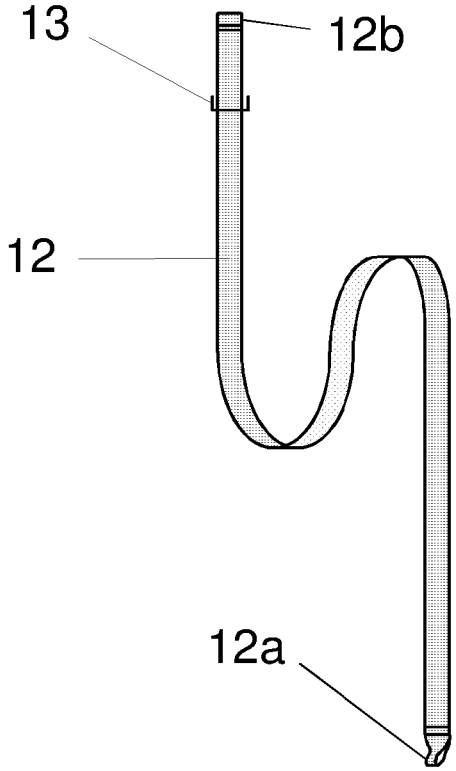
FIG. 3 is a diagram showing one embodiment of a lifting strap and lifting hook.
Figure 4:
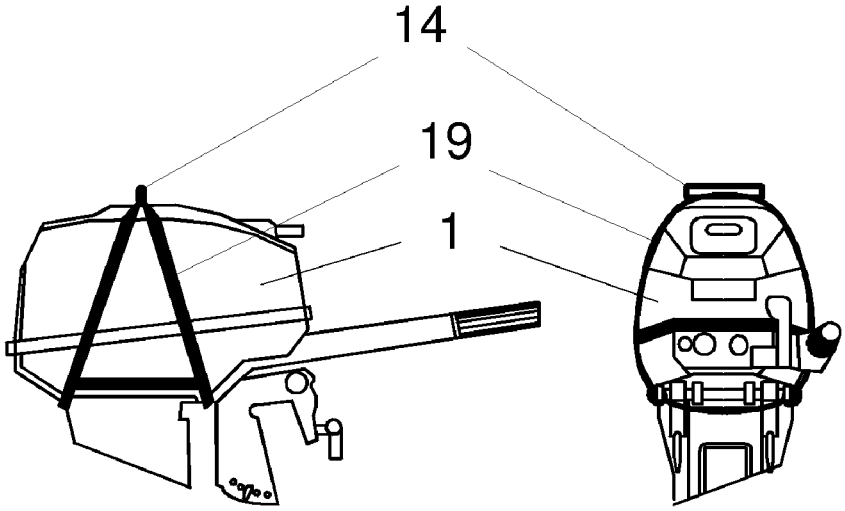
FIG. 4 is a diagram showing an example of an outboard lifting harness and handle for an outboard motor.
Figure 19:
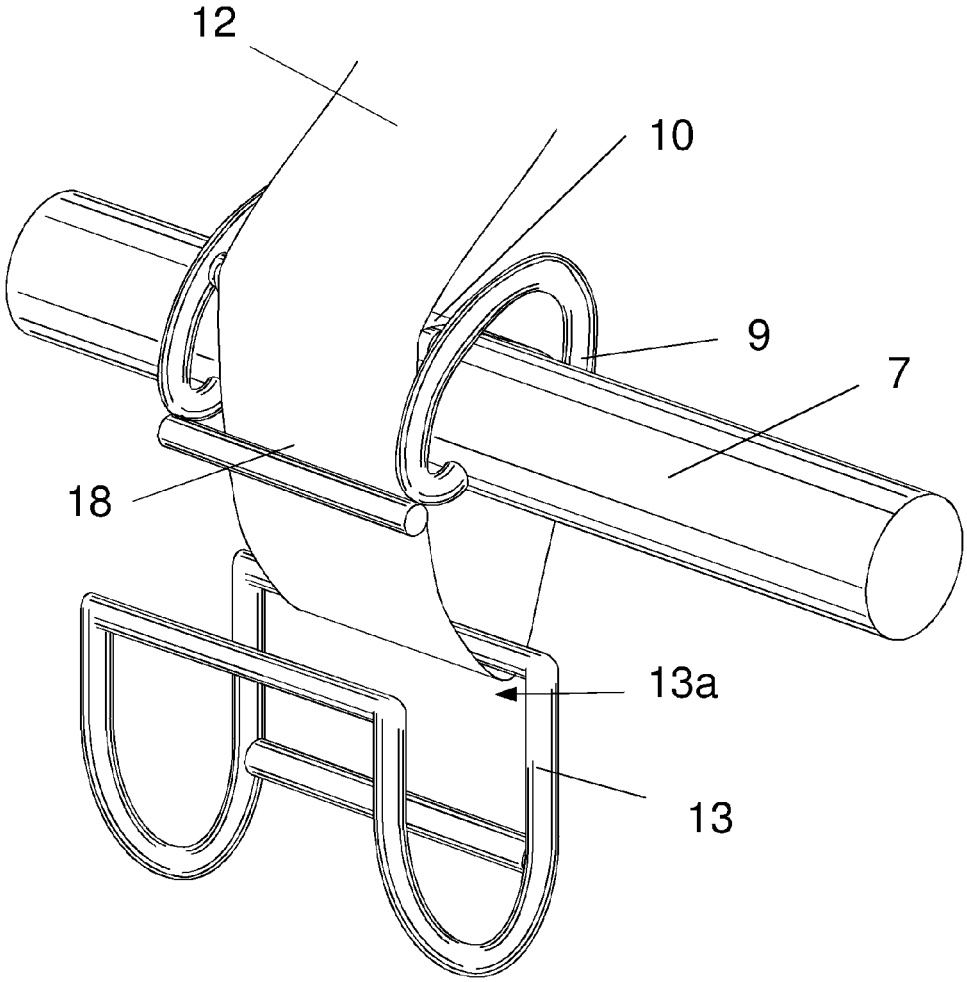
FIG. 19 is a perspective diagram showing details of one embodiment of the lifting strap attachment, fairlead, catching hook and lifting hook with the invention in the lowered position.

A lifting line or strap 12 (FIG. 3), is connected to a halyard 4 at its free end 12*a* and passes through a fairlead 18 on the free end of the pivot arm, through a second fairlead or bearing surface 13*a* on a lifting hook 13 (FIG. 19) and its second end 12*b* is fixed to an attachment point 10 on the pivot arm. The outboard motor 1 is configured with a lifting harness 19 having a handle 14 that may be placed on the lifting hook 13.

Figure 5:
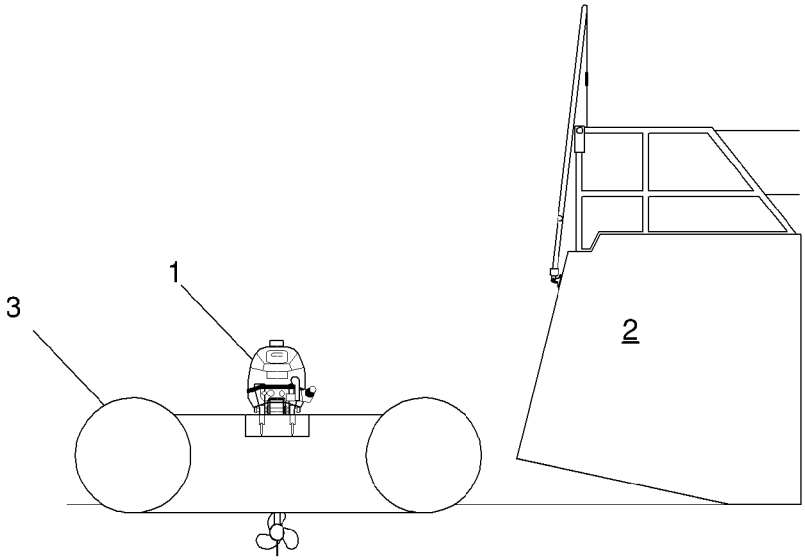
FIGS. 5-17 are a series of diagrams showing the sequential movement of one embodiment of the invention during operation.
Figure 6:
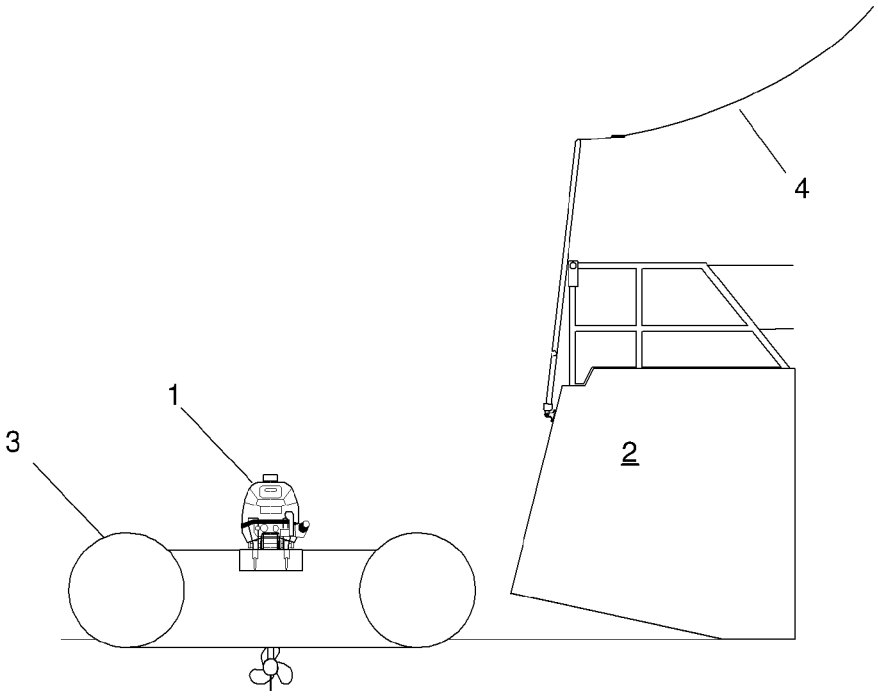
Figure 7:
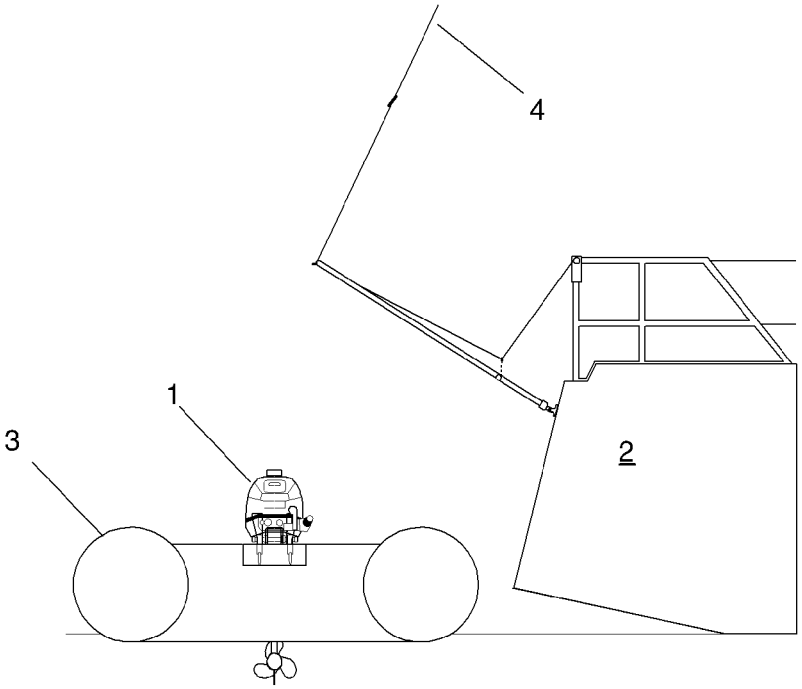
Figure 8:
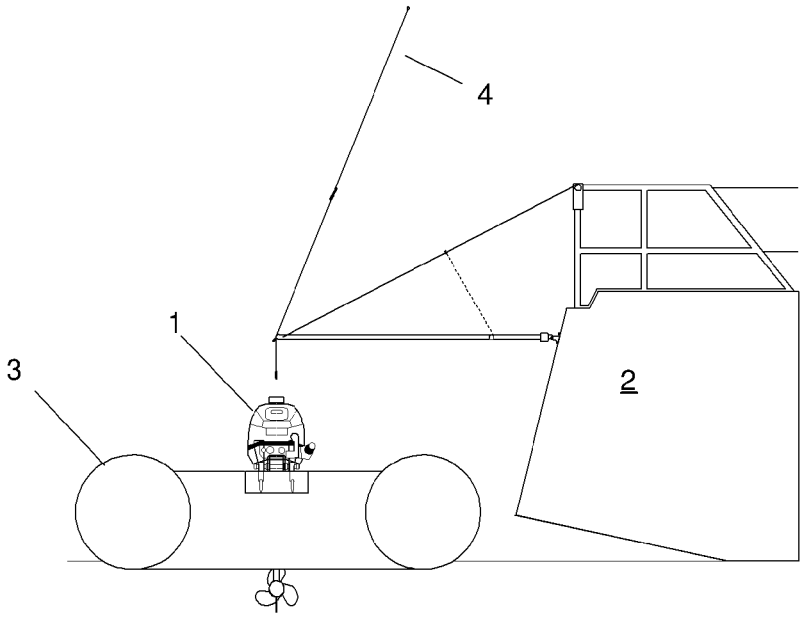
Figure 9:
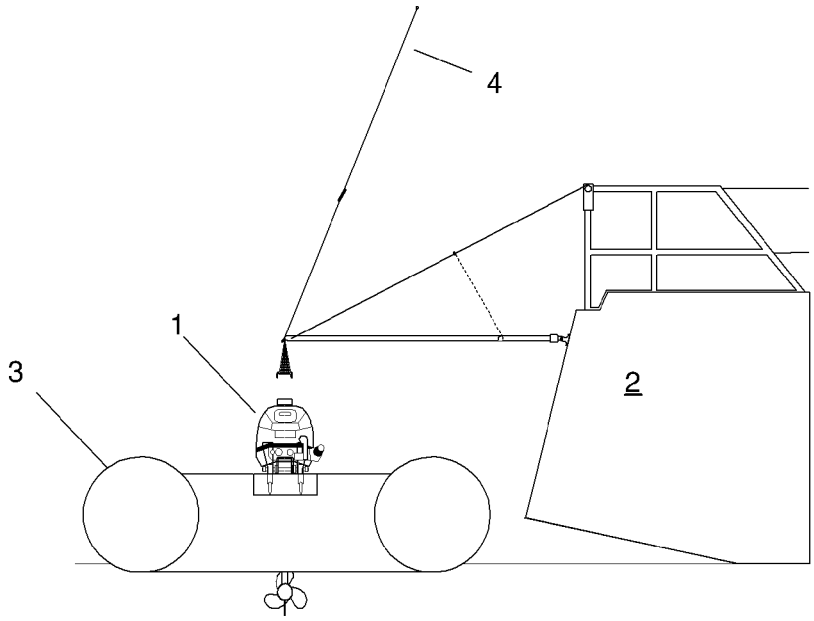
Figure 10:
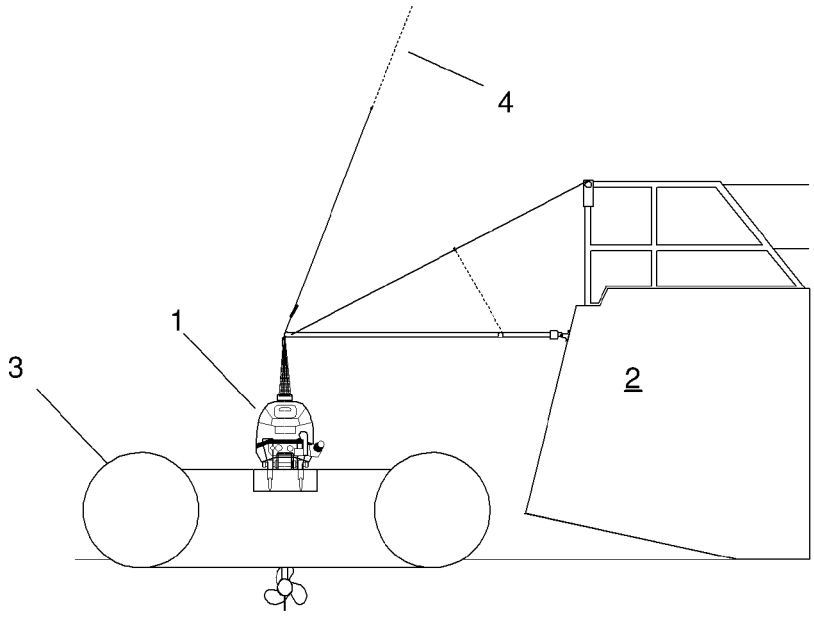

The system is used to raise the outboard motor from an operating position on the dinghy to the storage location on the boat as follows:

FIG. 5 shows the lifting device in the stored position on the boat and the outboard motor on the dinghy. As shown in FIG. 6 and FIG. 7, the halyard 4 is first connected to the free end 12*a* of the lifting strap 12 and the halyard is paid out to lower the pivot arm 7 until the restraining lines 15 limit the downward rotation of the pivot arm 7 as shown in FIG. 8. As shown in FIGS. 8-10, further easing of the halyard allows the lifting hook 13 and lifting strap 12 to be lowered until the lifting hook 13 can be hooked onto the outboard motor harness handle 14. Preferably, the motor harness handle of the harness is oriented to be generally parallel to the transverse (side to side) axis of the outboard motor.

Tension on the halyard or lifting line 4 provides a lifting force on the lifting hook 13, and outboard motor harness handle 14 and a downward force on the attachment point 10 of the pivot arm 7. The downward force on the attachment point 10 maintains the pivot arm's position at the lower limit, while the lifting force on the outboard motor harness 19 raises the outboard motor vertically off the mounting point on the dinghy 3. Depending on the orientation of the outboard motor 1 relative to the pivot arm, the lifting strap 12 will also exert a torsion force on the outboard motor harness handle 14 such that the outboard motor as it rises off the dinghy will rotate in order that the forward side of the outboard motor faces the boat 2. That is, as shown in the Figures, if the dinghy is oriented at 90 degrees to the orientation of the boat 2 and handle 14 is parallel to the transverse axis of the outboard motor, the motor will naturally turn as a result of the 90 degree "twist" placed in the strap 12 when lifting hook 13 was connected to the harness handle 14.

Figure 11:
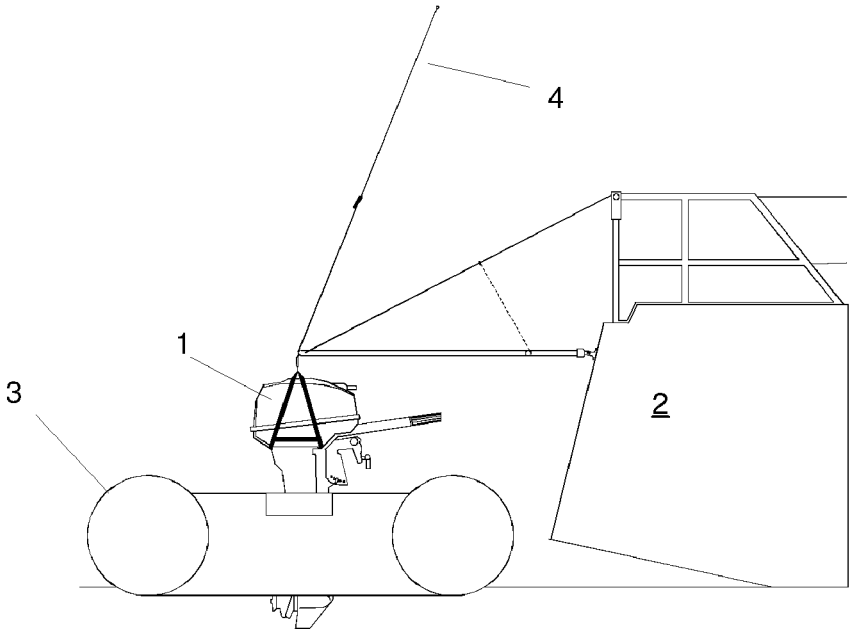
Figure 20A:
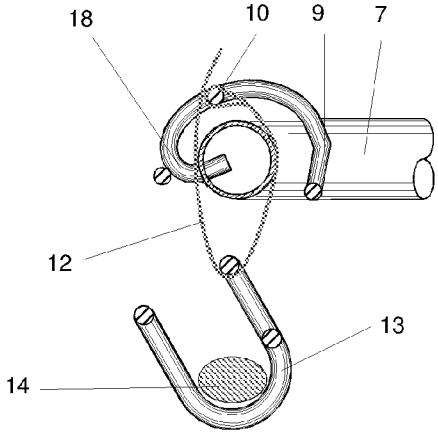
FIGS. 20(A)-(F) are cross sectional diagrams showing the sequential movement of a lifting hook and catching hook in accordance with one embodiment of the invention during operation.
Figure 20B:
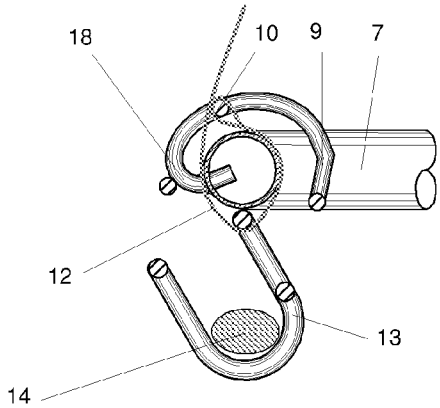

Continued tension on lifting line 4 raises the outboard motor 1 until the lifting hook 13 meets the pivot arm 7, as shown in FIG. 11 and FIG. 20(B).

Figure 12:
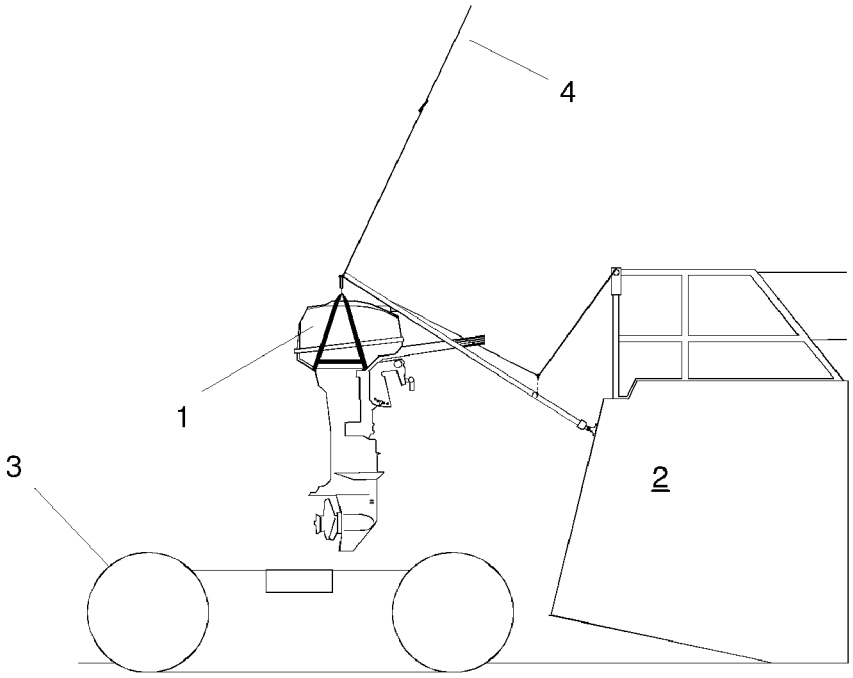
Figure 20C:
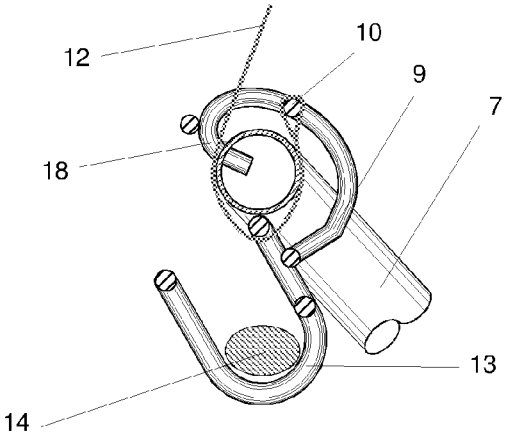

As shown in FIG. 12 and FIG. 20(C), once the lifting hook 13 meets the pivot arm 7, and continued upward tension is applied to the halyard, an upward force is applied on the free end of the pivot arm which is greater than the downward force exerted on the attachment point 10. As a result, the free end of the pivot arm 7 moves upward as the pivot arm 7 rotates about hinges 8.

Figure 13:
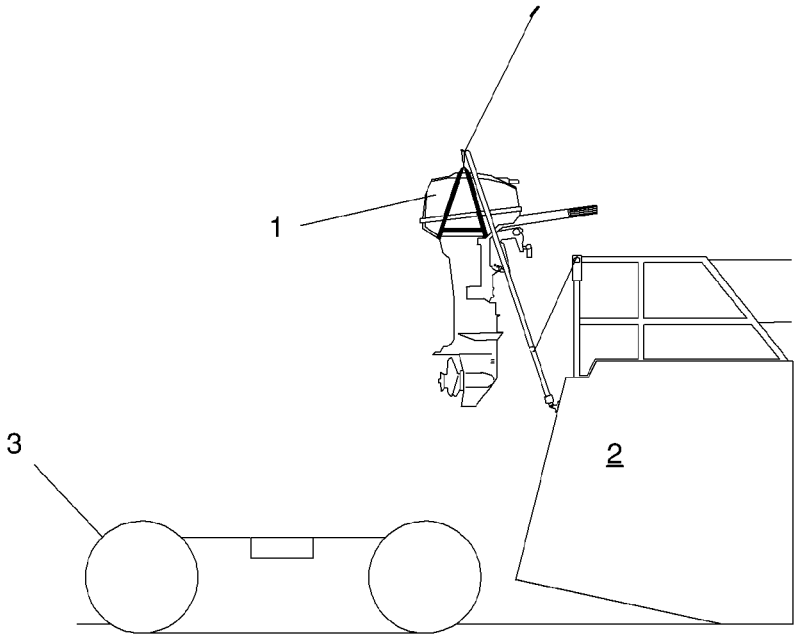

As shown in FIG. 13, continued tension on the halyard line 4 raises the free end of the pivot arm 7 and outboard motor 1 in an upward and forward arc about the hinges 8. In one embodiment, as shown in FIGS. 19-22, the lifting hook 13 is designed to engage with a catching hook 9 attached to the pivot arm 7 such that during rotation of the pivot arm 7, the lifting hook engages with the catching hook so as to transfer the load to the pivot arm at a predetermined position in the arc. This design ensures that at the upper positions of the arc, the load does not partially lower relative to the pivot arm as a result of decreased tension in the halyard as the load becomes increasingly supported by the pivot arm.

Figure 20D:
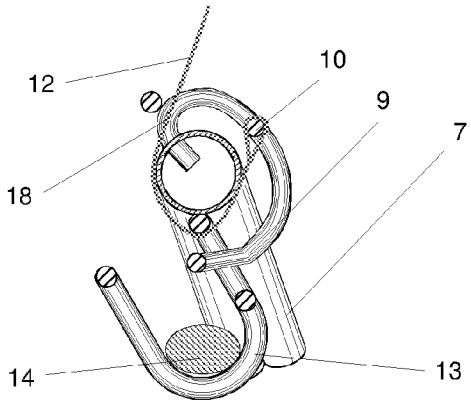

Accordingly, in this design, as the pivot arm moves upwards, the lifting hook moves over the catching hook so that at the point where halyard tension becomes lower than the weight of the load, the lifting hook is lowered onto the catching hook (FIGS. 20(D) and (E)).

Figure 20E:
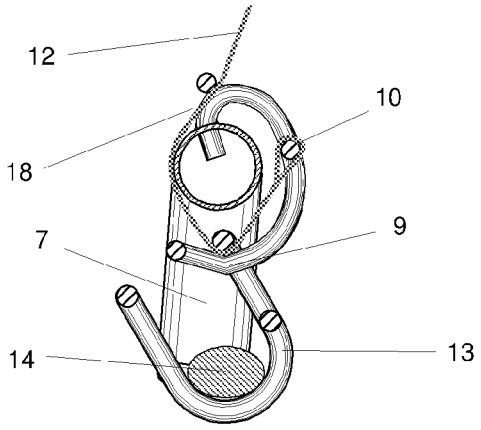

As a result, continued tension on the halyard line 4 thereby causes the pivot arm 7 to pivot upward while the catching hook 9 remains engaged with the lifting hook 13 as shown in FIG. 20(E).

Figure 14:
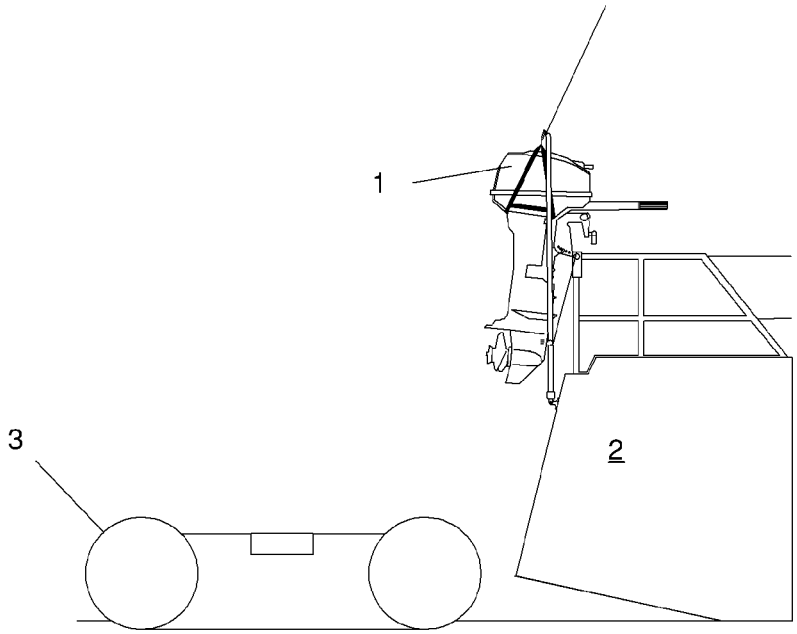
Figure 15:
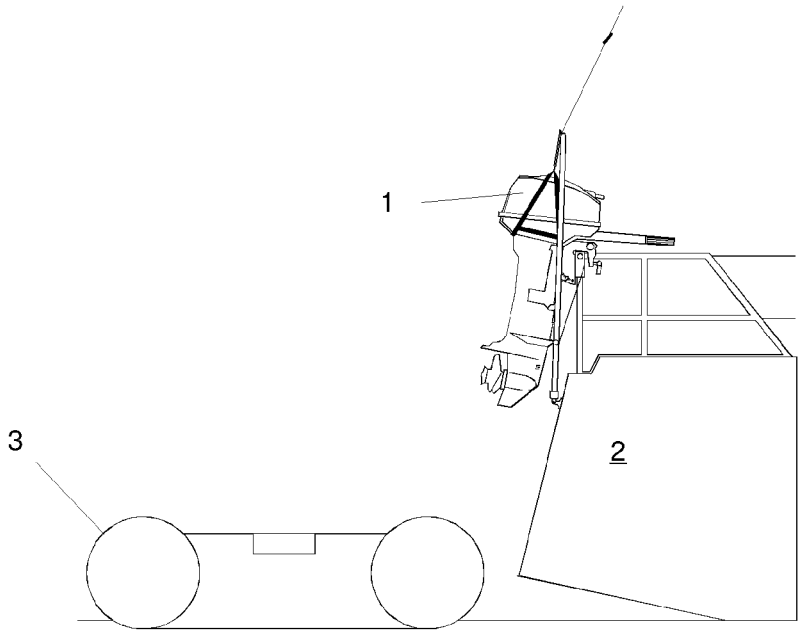

A cross-brace 11 on the pivot arm 7 prevents the lower section of the outboard motor 1 from swinging into contact with the boat 2, as shown in FIG. 14. The cross brace may be removable to enable other lifting functions to be performed as may be required.

Continued tension on the halyard line 4 causes the pivot arm 7 to continue to rotate upward, lifting the outboard motor 1 until the pivot arm 7 meets the railing 6, and/or the outboard motor 1 meets an outboard motor bracket 5 as shown in FIG. 14 or a releasable clasp 50 (FIG. 1). At this point the outboard motor 1 is suspended above the outboard motor bracket 5. Elastic lines 16 are fixed at one end to the free end of the pivot arm 7 and pass below the crossbrace 11 and are fastened to slip rings 17 that encircle the restraining lines 15. As the pivot arm rotates upward the elastic lines 16 contract, maintaining a small tension on the restraining lines 15 so that they are pulled taut along the pivot arm so as to prevent entanglement of the restraining lines 15 with other mechanisms, people or the boat.

In addition, as noted, the pivot arm may positively engage with a catch mechanism 50 (FIG. 1) mounted to the deck railing or other suitable attachment point to prevent the pivot arm moving backwards as halyard tension is released. The catch mechanism may include any suitable clasp mechanism that will automatically engage with the pivot arm as the pivot arm becomes vertical.

Figure 20F:
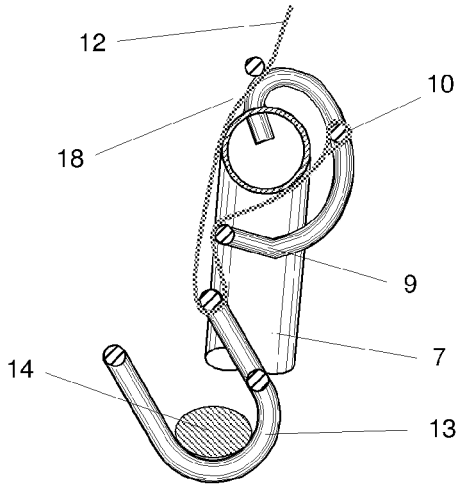
Figure 22:
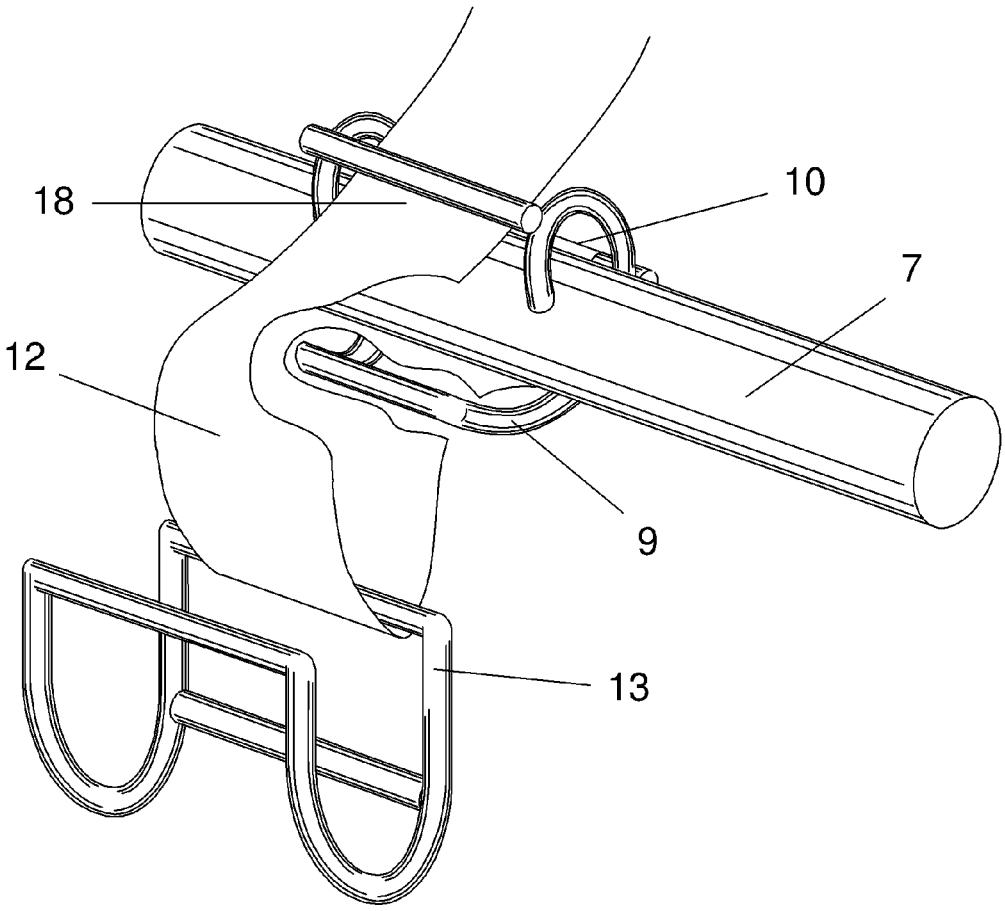

In order to secure the outboard motor on a mounting bracket 5, the operator may gently pull forward on the pivot arm 7 while gently reducing tension on the halyard line 4 and applying a small rearward pressure on the outboard motor to disengage the lifting hook 13 to from the catching hook 9 as shown in FIG. 20(F) and FIG. 22. Continued lowering of the halyard allows the outboard motor 1 to be lowered vertically onto the outboard mounting bracket 5 where it can be clamped in place for storage, as shown in FIGS. 15-18. In one embodiment, as noted above, the catch mechanism 50 may be used to prevent the pivot arm from swinging backwards.

Figure 16:
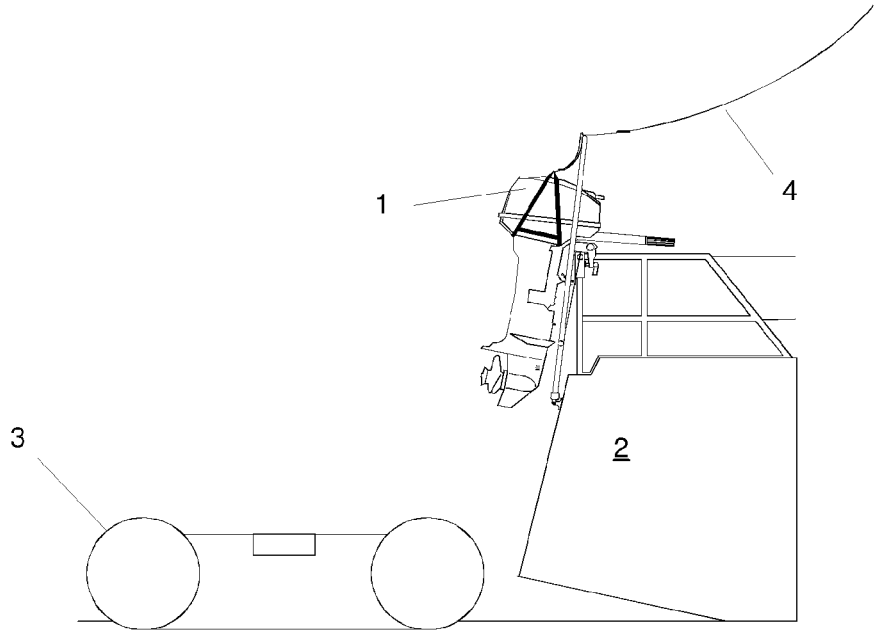
Figure 17:
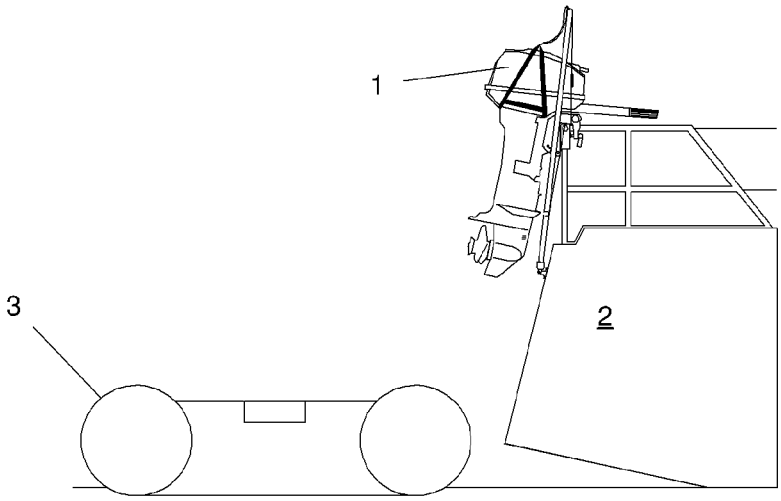
Figure 18:
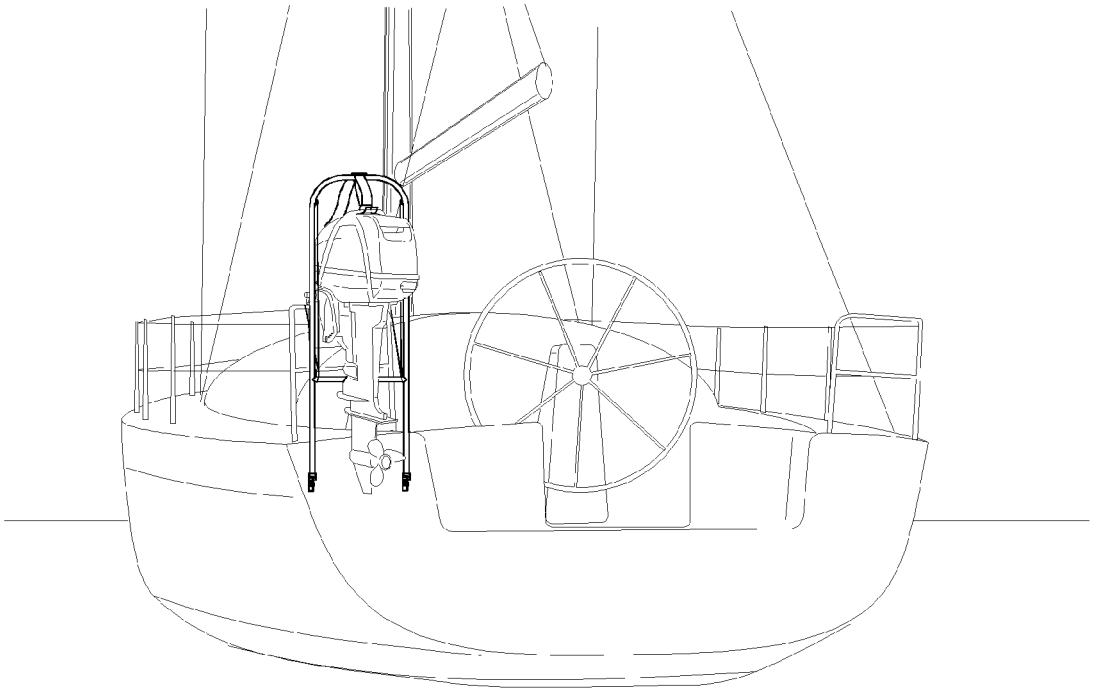
FIG. 18 is a perspective diagram showing one embodiment of the invention in a raised position.
Figure 21:
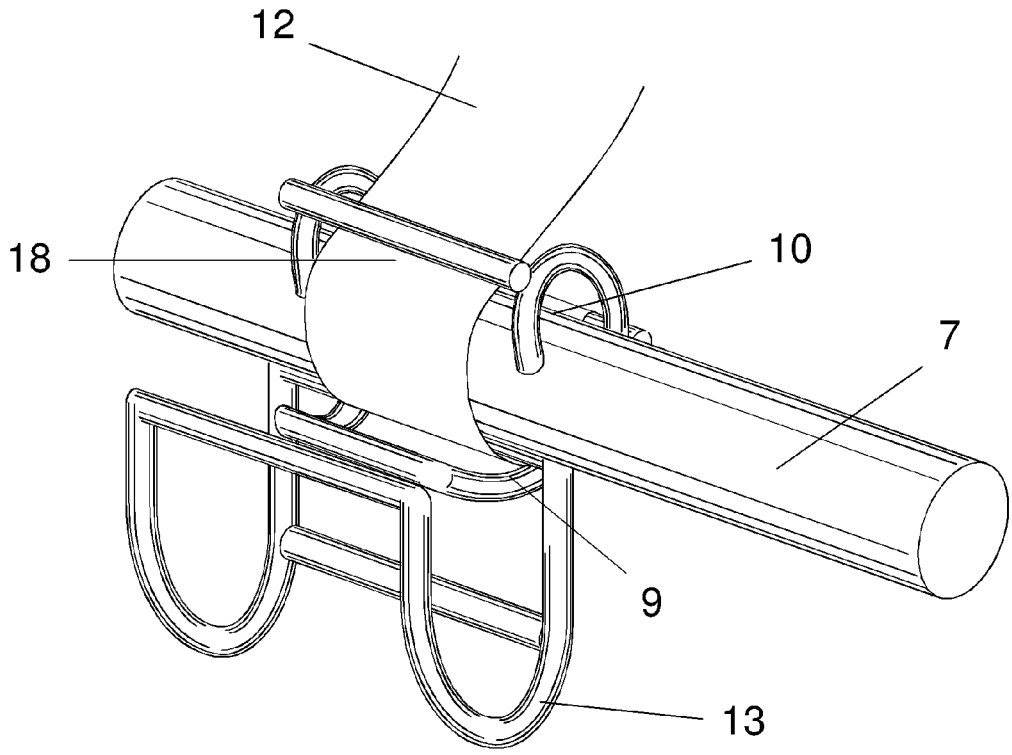
FIG. 21 is a perspective diagram showing details of one embodiment of a lifting strap attachment, fairlead, catching hook and lifting hook in the upper position; and, FIG. 22 is a perspective diagram showing details of one embodiment of a lifting strap attachment, fairlead, catching hook and lifting hook in the upper position with the lifting hook lowered.

The system is used to lower the outboard motor from the storage location on the boat to the operating position on the dinghy by reversing the process as follows:

As shown in FIGS. 16 and 22, with the halyard line 4 and lifting strap 12 loose, the lifting hook 13 can be lowered to engage with the harness handle 14 on the outboard motor 1. As shown in FIG. 20(F), tension on the halyard line 4 causes an upward force on the outboard motor harness 14, lifting the outboard motor 1 until the lifting hook 13 meets the catching hook 9, as shown in FIGS. 14 and 21. Subsequent easing of the tension on the halyard 4 causes the lifting hook 13 to be pulled downward by the weight of the outboard motor 1 until the lifting handle 13 meets the catching hook 9 as shown in FIG. 20(E).

The operator gently pushes backward on the free end of the pivot arm 7 and eases the tension on the halyard line 4, causing the pivot arm 7 to rotate backward and downward, lowering the outboard motor 1 in a backward and downward arc as shown in FIGS. 12 and 13. At this stage, if a catch mechanism 50 is employed, the operator releases the catch mechanism to enable the pivot arm to move rearwardly. At a point in the downward arc, the upward vertical component of the force exerted by the lifting line 12 on the pivot arm 7 reduces to less than the downward force on the pivot arm attachment point 10, causing the free end of the pivot arm 7 to move closer to the lifting hook 13, such that the catching hook 9 disengages from the lifting hook 13 as shown in FIG. 20(D).

Continued easing of the halyard tension causes the pivot arm 7 to continue rotating downward and backward until the restraining lines 15 are taut as shown in FIG. 11. The resulting tension in the restraining lines 15 prevents any further downward rotation of the pivot arm 7.

Continued easing of the halyard tension causes the lifting strap 12 to run through the pivot arm fairlead 18 and the lifting hook 13 such that the lifting hook moves downward, lowering the outboard motor 1 to the dinghy.

The operator then rotates the outboard motor 1 about a vertical axis to align the motor with the motor mount on the dinghy 3 as may be necessary based on the orientation of the dinghy. Continued easing of the halyard tension causes the outboard motor 1 to move downward onto the dinghy 3 as shown in FIG. 10. The operator then clamps the outboard motor 1 to the dinghy 3 and disengages the lifting hook 13 from the outboard motor harness handle 14, as shown in FIG. 9, to complete the operation.

In other embodiments, the pivot arms may be telescopic in order to minimize the vertical height of the pivot arms during storage or non-use of the system.

In other embodiments, the system may utilize other systems for ensuring that the load does not separate from the pivot arm as the tension on the lifting line lowers in the upper regions of the lifting arc. For example, in one embodiment, the strap 12 may include a one-way lock system, such as a toothed camming surface that allows the strap to be tightened in one direction but that will prevent the strap from being loosened in the other direction unless the locking mechanism is released. Accordingly, in this embodiment, during operation, the strap would be fully tightened and secured during initial vertical lifting of the load with the pivot arm in the lower or upper position. After lifting or lowering, the operator would release tension on the halyard and release the locking mechanism to lower or otherwise release the load.

In an alternate use of the system, the system may be used as an effective lifting system for recovering a man-overboard. For example, instead of a motor harness 19 being attached to the lifting hook, the operator can attach a manoverboard harness, seat or other suitable system for assisting a person to be recovered from the water. In operation, particularly in rougher seas, where a vessel may be being pitched around, the system minimizes the risk of the recovered person being hit by the hull of the vessel as the recovery vessel comes alongside. Moreover, the system further ensures that the man-overboard is recovered by lifting them through an arc rather than requiring the difficult lifting process of pulling them directly vertically from the water where they may be dragged against various outer structures of the vessel.

The system may also be used for lifting other cargoes from a dock to the vessel with the use of other cargo harnesses.

The system may be effectively incorporated as a retro-fit to existing deck railing or other support structures common on many types and designs of boats. Alternatively, the system may be specifically incorporated into the original equipment of a boat as understood by those skilled in the art. In one particular embodiment of the system, the system is integrated with a railing as a specific opening in the railing which is particularly effective when the system is used for man-overboard recovery.

What is claimed is:

1. A lifting system for use with a boat for vertically and horizontally moving a load to and from a boat, comprising:

a pivot arm having a cross member defining a free end and two legs for pivotable connection to a boat, the pivot arm operable between a lower position and an upper position wherein the cross member is sized to permit the load to pass between the two legs such that the load does not interfere with the pivot arm when the pivot arm is in a substantially vertical upper position;

a catching hook connected to the free end in a fixed orientation having a catching surface;

a lifting line having a first end operatively connected to the free end;

a lifting hook slidably engaged with the lifting line, the lifting hook having a lifting hook surface oriented to engage and disengage with the catching surface at a pre-determined position between the upper and lower position;

wherein applying tension to the lifting line when the pivot arm is in the lower position causes arcuate upward movement of the pivot arm and lifting hook such that at the pre-determined position between the lower position and upper position, the lifting hook surface engages with the catching surface to transfer the load to the pivot arm as the pivot arm is moving and wherein releasing tension on the lifting arm when the pivot arm is in the upper position causes downward arcuate movement of the pivot arm and lifting hook such that, at the predetermined position, the lifting hook surface disengages with the catching surface to transfer the load to the lifting line while the lifting line is in tension.

2. A lifting system as in claim 1 further comprising at least one supporting line operatively connected to the pivot arm and the boat for supporting the pivot arm in the lower position.

3. A lifting system as in claim 2 further comprising at least one elastic line operatively connected to the at least one supporting line for maintaining tension in the supporting lines when the pivot arm is in the upper position.

4. A lifting system as in claim 1 wherein the lifting line includes a strap capable of inducing a torsional force to the load to allow the load to pass through the two legs.

5. A lifting system as in claim 1 further comprising a pivot arm catch for releasably securing the pivot arms in the upper position, the pivot arm catch for operative attachment to the boat.

6. A lifting system as in claim 1 wherein the lifting line includes a strap and the load is an outboard motor, the lifting system further comprising a harness for supporting the outboard motor and wherein the harness, strap and lifting hook are arranged in order to allow rotation of the outboard motor to fit between the pivot arm legs in the upper position from induced torsional tension within the strap.

7. A lifting system as in claim 1 further comprising a harness adapted for lifting a person.

8. A lifting system as in claim 1 wherein the legs are telescopic.

9. A lifting system as in claim 1 further comprising a second cross member between the legs for preventing the load from passing completely through the pivot arm.

10. A lifting system as in claim 1 wherein the lifting line is adapted for attachment to a halyard on a boat.

11. A system as in claim 1 wherein the lifting system is attached between two vertical railing posts on a boat.

12. A lifting system for use with a boat for vertically and horizontally moving a load to and from a boat, comprising:

a pivot arm having a cross member defining a free end and two legs for pivotable connection to a boat, the pivot arm operable between a lower position and an upper position;

a load supporting system operatively connected to the free end of the pivot arm and for operative connection to a lifting line on the boat, the load supporting system operatively retaining a lifting hook for connection to a load, the load supporting system including a securing system for securing the lifting hook in close proximity to the pivot arm and wherein, when a lifting tension is applied to the lifting line, the load supporting system causes the pivot arm to pivot upwardly;

at least one supporting line operatively connected to the pivot arm and the boat for supporting the pivot arm in the lower position; and at least one elastic line operatively connected to the at least one supporting line for maintaining tension in the supporting lines when the pivot arm is in the upper position;

wherein the cross member is sized to permit the load to pass between the two legs such that the load does not interfere with the pivot arm when the pivot arm is in a substantially vertical upper position; and wherein the securing system includes an open catching hook having a catching surface operatively connected to the free end, the catching surface oriented to engage and support the lifting hook and load when the pivot arm is above a pre-determined position between the lower position and upper position and wherein the catching surface is oriented to disengage from the lifting hook when the pivot arm is below the pre-determined position while the lifting line is in tension.

* * * * *